US009771733B2

(12) United States Patent
Faries et al.

(10) Patent No.: US 9,771,733 B2
(45) Date of Patent: Sep. 26, 2017

(54) EMBEDDED POLES FOR UTILITY POLES AND STRUCTURES

(71) Applicant: Trinity Meyer Utility Structures, LLC, Dallas, TX (US)

(72) Inventors: Guy L. Faries, Memphis, TN (US); Mark H. Fairbairn, Red Wing, MN (US)

(73) Assignee: Trinity Meyer Utility Structures, LLC, Dallas, TX (US)

( * ) Notice: Subject to any disclaimer, the term of this patent is extended or adjusted under 35 U.S.C. 154(b) by 0 days.

(21) Appl. No.: 15/049,492

(22) Filed: Feb. 22, 2016

(65) Prior Publication Data

US 2017/0241154 A1 Aug. 24, 2017

(51) Int. Cl.

| | |
|---|---|
| ***E04H 12/22*** | (2006.01) |
| ***E02D 27/50*** | (2006.01) |
| ***E02D 27/42*** | (2006.01) |

(52) U.S. Cl.

CPC ..... *E04H 12/2223* (2013.01); *E02D 27/42* (2013.01); *E02D 27/50* (2013.01); *E04H 12/223* (2013.01); *E04H 12/2269* (2013.01)

(58) Field of Classification Search

CPC ..... E04H 12/2223; E04H 12/2269; E04H 12/223; E02D 27/50; E02D 27/42

See application file for complete search history.

(56) References Cited

U.S. PATENT DOCUMENTS

| | | | | |
|---|---|---|---|---|
| 4,803,812 | A * | 2/1989 | Alexander, Sr. | E02D 5/801 52/157 |
| 5,516,237 | A * | 5/1996 | Hebant | E02D 27/42 405/133 |
| 6,202,368 | B1 * | 3/2001 | Wallace, III | E02D 5/801 248/156 |
| 6,260,314 | B1 * | 7/2001 | Church | E04H 15/62 248/523 |
| 6,547,203 | B1 * | 4/2003 | Willard | E04H 12/2223 248/530 |
| 6,575,853 | B1 * | 6/2003 | O'Neill | A63B 63/083 473/481 |
| 6,722,821 | B1 * | 4/2004 | Perko | E02D 5/801 405/249 |
| 7,575,215 | B1 * | 8/2009 | Clark | A01K 97/10 248/222.11 |
| 7,637,075 | B2 * | 12/2009 | Mitchell | E04H 12/003 52/170 |
| 8,704,089 | B2 * | 4/2014 | Atchley | H02G 9/06 174/38 |

(Continued)

*Primary Examiner* — Rodney Mintz

(74) *Attorney, Agent, or Firm* — Baker Botts, LLP

(57) ABSTRACT

An embedded pole installation method including applying a rotational force to a leading pole and an intermediate pole. The leading pole comprises a first helical plate disposed on a first portion of the leading pole. The intermediate pole is coupled to a second portion of the leading pole and comprises a second helical plate disposed on a first portion of the intermediate pole. The diameter of the intermediate pole is greater than a diameter of the leading pole. Applying the rotational force embeds the first helical plate and the second helical plate into a foundation such that a second portion of the intermediate pole does not penetrate the foundation. The method further includes coupling a utility pole to the second portion of the intermediate pole.

19 Claims, 5 Drawing Sheets

(56) References Cited

U.S. PATENT DOCUMENTS

| | | | | |
|---|---|---|---|---|
| 8,863,450 | B2 * | 10/2014 | Anderson | E04H 12/345 52/117 |
| 9,057,169 | B1 * | 6/2015 | Perko | E02D 5/56 |
| 9,512,589 | B1 * | 12/2016 | Van Polen | E02D 7/28 |
| 2003/0159839 | A1 * | 8/2003 | Perko | E02D 5/56 172/100 |
| 2004/0194400 | A1 * | 10/2004 | Ray | E02D 27/42 52/169.9 |
| 2004/0221543 | A1 * | 11/2004 | Eleas | E02D 5/56 52/153 |
| 2006/0138208 | A1 * | 6/2006 | Lackey | A47G 29/1216 232/39 |
| 2007/0017166 | A1 * | 1/2007 | Nicolet | E02D 5/74 52/155 |
| 2008/0156957 | A1 * | 7/2008 | Nervi | G09F 7/22 248/530 |
| 2009/0035070 | A1 * | 2/2009 | Kwon | E02D 27/42 405/244 |
| 2012/0230004 | A1 * | 9/2012 | Atchley | H02G 9/06 361/825 |
| 2013/0227897 | A1 * | 9/2013 | Palmer | E02D 27/42 52/157 |
| 2014/0115978 | A1 * | 5/2014 | Fairbairn | E02D 27/42 52/126.1 |
| 2014/0259832 | A1 * | 9/2014 | Todd | G09F 15/0075 40/607.03 |
| 2015/0090857 | A1 * | 4/2015 | Walker | E04H 12/2238 248/535 |
| 2016/0024739 | A1 * | 1/2016 | Kelleher | E04H 12/223 405/232 |

* cited by examiner

EMBEDDED POLES FOR UTILITY POLES AND STRUCTURES

TECHNICAL FIELD

This disclosure relates generally to embedded pole systems, and more specifically to systems and methods for installing utility poles into a foundation.

BACKGROUND

Installing embedded poles into a foundation (e.g. the ground) can be costly and time consuming. Existing embedded pole systems first require a hole to be dug into the ground which creates spoils as the hole is dug. The embedded pole system is then installed into the ground and the spoils that were created are backfilled into the ground to secure the embedded pole. Additional material such as concrete or grout may also be introduced into the ground to secure the embedded pole system within the ground. Backfilling and adding additional material to secure the embedded pole system introduces costs and delays to the embedded pole system installation. It is desirable to provide an embedded pole system that reduces the need for backfilling and using additional materials for securing an embedded pole into the ground.

SUMMARY

In one embodiment, the disclosure includes an embedded pole installation method comprising applying a rotational force to a leading pole and an intermediate pole. The leading pole comprises a first helical plate disposed on a first portion of the leading pole. The intermediate pole is coupled to a second portion of the leading pole and comprises a second helical plate disposed on a first portion of the intermediate pole. The diameter of the intermediate pole is greater than a diameter of the leading pole. Applying the rotational force embeds the first helical plate and the second helical plate into a foundation such that a second portion of the intermediate pole does not penetrate the foundation. The method further comprises coupling a utility pole to the second portion of the intermediate pole.

In another embodiment, the disclosure includes an embedded pole system comprising a leading pole and an intermediate pole. The leading pole comprises a first helical plate disposed on a first portion of the leading pole. The intermediate pole is coupled to a second portion of the leading pole and comprises a second helical plate disposed on a first portion of the intermediate pole. The diameter of the intermediate pole is greater than a diameter of the leading pole.

Various embodiments present several technical advantages, such as an embedded pole system that allows for a quick installation of a utility pole with a pole into the ground without the need for backfilling or introducing additional materials (e.g. cement) into the ground. The pole uses a helical plate that allows the pole to be installed firmly secured into the ground while producing little to no spoils. The utility pole may be integrated with the pole once the pole is installed in the ground, which simplifies the installation process and reduces the time and costs associated with installing an embedded poles system.

Certain embodiments of the present disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Disclosed herein are various embodiments for providing an embedded pole system that allows utility poles to be installed without needing to backfill or use additional material (e.g. cement) to secure the embedded pole system and the utility pole. The embedded pole system uses one or more helical plates to embed (e.g. screw) a first portion of a pole into a foundation (e.g. the ground) such that a second portion of the pole does not penetrate the foundation. The utility pole may then be installed onto the second portion of the pole. In one embodiment, the utility pole may use a slip joint or friction between an interior surface of the utility pole and an exterior surface of the pole to couple the utility pole to the pole. Additional details for coupling the utility pole and the pole using friction are discussed in FIGS. 1 and 2. In another embodiment, the utility pole and the pole are coupled together using base plates that are disposed onto the pole and the utility pole. Additional details for coupling the utility pole and the pole using base plates are discussed in FIG. 3.

Figure 1:
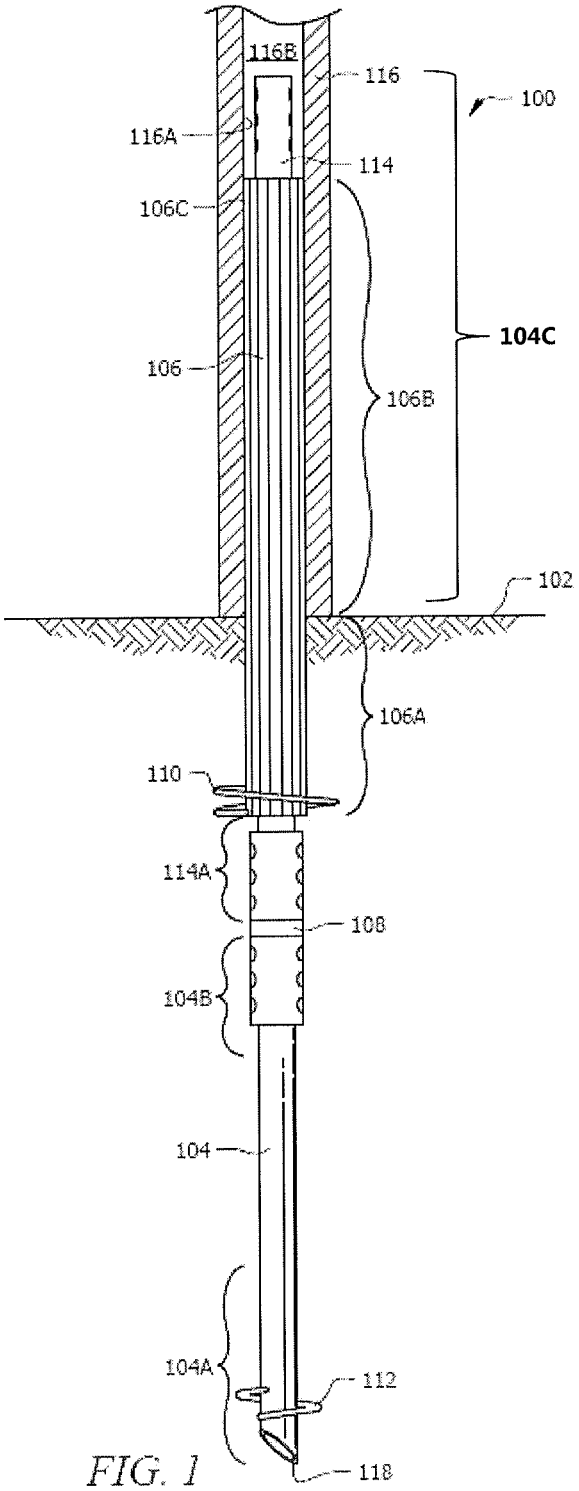
FIG. 1 is a schematic diagram of an embodiment of an embedded pole system with a leading pole.

FIG. 1 is a schematic diagram of an embodiment of an embedded pole system 100 with a leading pole 104. The embedded pole system 100 comprises the leading pole 104 coupled to an intermediate pole 106. The intermediate pole 106 is configured to couple to and support a utility pole 116. The embedded pole system 100 may be configured such that the leading pole 104 and a first portion 106A of the intermediate pole 106 are disposed within a foundation (e.g. the ground) 102 and such that a second portion 106B of the intermediate pole 106 is coupled to the utility pole 116 above the surface of the foundation 102 and does not penetrate the foundation 102. For example, the leading pole 104 and the first portion 106A of the intermediate pole 106 may be embedded or screwed into the ground when a rotational force is applied to the intermediate pole 106. The utility pole 116 and the second portion 106B of the intermediate pole 106 may be configured to extend out of the ground.

The intermediate pole 106 is a tubular pole with a helical plate 110 disposed on the first portion 106A of the intermediate pole 106. The helical plate 110 may be welded, bonded, or formed onto the intermediate pole 106. The helical plate 110 may comprise any suitable number of helices and any suitable diameter of helices as would be appreciated by one of ordinary skill in the art upon viewing this disclosure. The intermediate pole 106 is configured to embed the helical plate 110 into the foundation 102 by applying a rotational force to the intermediate pole 106. In one embodiment, the intermediate pole 106 is a tapered multi-sided pole, for example, a 12-sided pole. The outer surface 106C of the second portion 106B of the intermediate pole 106 is configured to mate with or engage an inner surface 116A of the utility pole 116. For example, the outer surface 106C of the intermediate pole 106 is configured to engage the inner surface 116A of the utility pole 116, which couples the intermediate pole 106 and the utility pole 116 using the friction between the outer surface 106C and the inner surface 116A to form a slip joint between the intermediate pole 106 and the utility pole 116. In one embodiment, the intermediate pole 106 and the utility pole 116 may be coupled together using a hydraulic jack to forcibly couple the intermediate pole 106 and the utility pole 116 together. In one embodiment, the intermediate pole 106 is tapered such that the diameter of the intermediate pole 106 at the first portion 106A is greater than the diameter of the intermediate pole 106 at the second portion 106B.

The utility pole 116 is a tubular pole, for example, a tapered tubular pole. In one embodiment, the utility pole 116 is a tapered multi-sided pole, for example, a 12-sided pole. An example of the utility pole 116 includes, but is not limited to, an electric power transmission pole. The utility pole 116 may be formed of a metal (e.g. steel), a composite (e.g. fiberglass), or any other suitable material as would be appreciated by one of ordinary skill in the art upon viewing this disclosure. In an embodiment, the utility pole 116 may be configured to support overhead power lines and/or other public utilities such as cables, fiber optic cables, telephone lines, transformers, and street lights. The utility pole 116 is configured to be positioned and disposed onto the outer surface 106C of the second portion 106B of the intermediate pole 106 such that at least a portion of the intermediate pole 106 is within a recess defined by the utility pole 116, for example, the bore 116B of the utility pole 116. The recess defined by the utility pole 116 may be configured to correspond with the second portion 106B of the intermediate pole 106. For example, the recess may be configured to be multi-sided and to align or mate with the outer surface 106C of the second portion 106B of the intermediate pole 106. The recess may be configured with any suitable shape or dimensions to engage with the second portion 106B of the intermediate pole 106 as would be appreciated by one of ordinary skill in the art upon viewing this disclosure.

In one embodiment, the intermediate pole 106 includes an inner sleeve 114 that is disposed longitudinally within in the intermediate pole 106 in a recess defined by the intermediate pole 106, for example, the bore of the intermediate pole 106. The inner sleeve 114 is a tubular pole. The inner sleeve 114 may be coupled to intermediate pole 106 using a welded plate (not shown), welds, bolts, or any other mechanism for coupling the inner sleeve 114 to the intermediate pole 106 as would be appreciated by one of ordinary skill in the art upon viewing this disclosure. The inner sleeve 114 is configured such that at least a first portion 114A of the inner sleeve 114 is not enclosed within the recess (e.g. the bore) of the intermediate pole 106. The first portion 114A of the inner sleeve 114 may be configured to couple to the leading pole 104, which is described in more detail below.

In one embodiment, the leading pole 104 is a tubular pole or sleeve with a helical plate 112 disposed on a first portion 104A of the leading pole 104. The leading pole 104 has a diameter that is less than the diameter of the intermediate pole 106. Examples of the leading pole 104 include, but are not limited to, a screw pile and a helical pile. The helical plate 112 may be welded, bonded, or formed onto the leading pole 104. The helical plate 112 may comprise any suitable number of helices and any suitable diameter of helices as would be appreciated by one of ordinary skill in the art upon viewing this disclosure. The leading pole 104 is configured to embed the helical plate 112 into the foundation 102 by applying a rotational force to the leading pole 104, for example, via the intermediate pole 106. In one embodiment, the leading pole 104 may have an angled cut or pile toe at the first portion 104A of the leading pole 104. The leading pole 104 is configured to be coupled to the intermediate pole 106 via the first portion 114A of the inner sleeve 114 at a second portion 104B of the leading pole 104, which is described in more detail below, such that a third portion 104C of the leading pole 104 is above ground.

In one embodiment, the leading pole 104 is coupled to the first portion 114A of the inner sleeve 114 using a coupler 108, for example, a removable coupler. An example of a coupler 108 includes, but is not limited to, a tubular pole with a diameter that is greater than the diameter of the first portion 114A of the inner sleeve 114 and the diameter of the second portion 104B of the leading pole 104. The coupler 108 may be configured to attach to and couple the second portion 104B of the leading pole 104 and a first portion 114A of the inner sleeve 114 using one or more fasteners. Examples of fasteners include, but are not limited to, bolts, screws, and clamps. In another embodiment, the leading pole 104 may be coupled to the first portion 114A of the inner sleeve 114 using a fixed connection, for example, a weld or bond. In another embodiment, the second portion 104B of the leading pole 104 and a first portion 114A of the inner sleeve 114 are coupled together using a plurality of couplers 108 and pole extensions (not shown) to extend the length of the leading pole 104.

Figure 2:
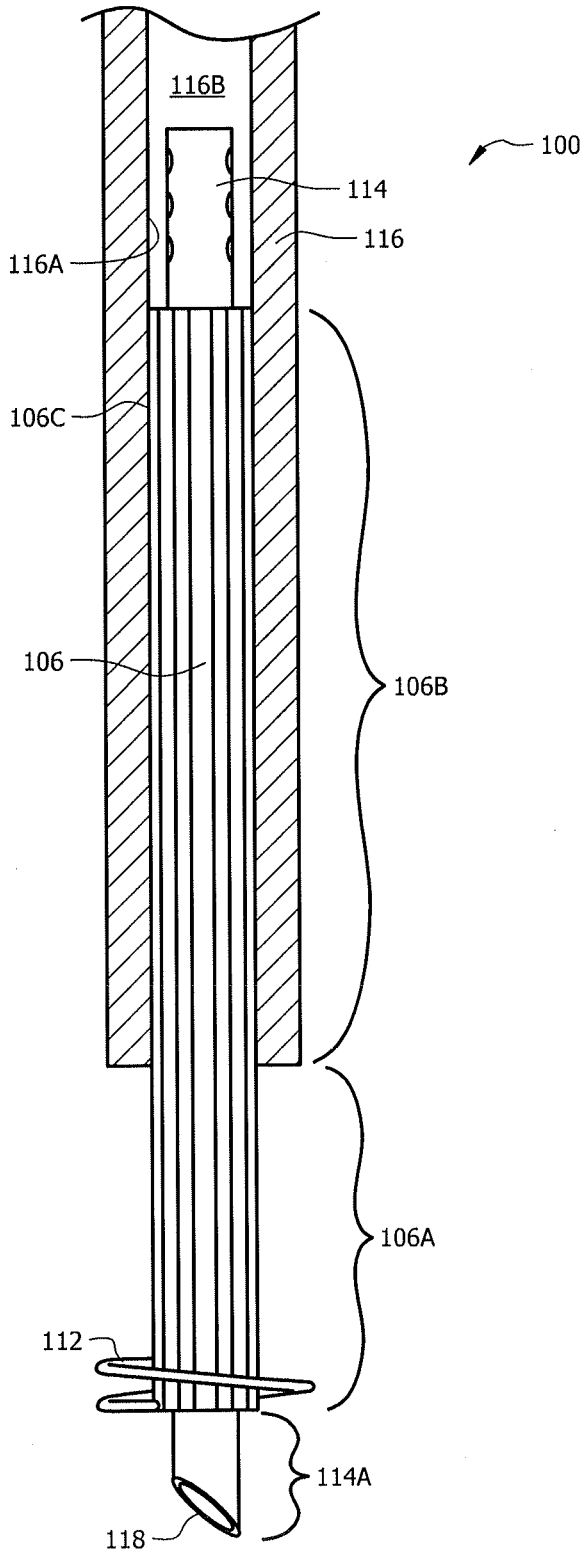
FIG. 2 is a schematic diagram of an embodiment of an embedded pole system without a leading pole.

FIG. 2 is a schematic diagram of an embodiment of an embedded pole system 100 without the leading pole 104. The embedded pole system 100 comprises an intermediate pole 106 and an inner sleeve 114. The intermediate pole 106 and the inner sleeve 114 may be configured similarly to as described in FIG. 1. The embedded pole system 100 may be configured such that the first portion 114A of the inner sleeve 114 and the first portion 106A of the intermediate pole 106 are disposed within a foundation 102 and such that the second portion 106B of the intermediate pole 106 is coupled to the utility pole 116 above the surface of the foundation 102. The second portion 106B of the intermediate pole 106 and the utility pole 116 do not penetrate the foundation 102. The outer surface 106C of the second portion 106B of the intermediate pole 106 is configured to mate with or engage the inner surface 116A of the utility pole 116. For example, the outer surface 106C of the intermediate pole 106 is configured to engage the inner surface 116A of the utility pole 116, which couples the intermediate pole 106 and the utility pole 116 using the friction between the outer surface 106C and the inner surface 116A to form a slip joint between the intermediate pole 106 and the utility pole 116. The utility pole 116 may be configured similarly to as described in FIG. 1. In FIG. 2, the inner sleeve 114 has an angled cut or pile toe at the first portion 114A of the inner sleeve 114.

Figure 3:
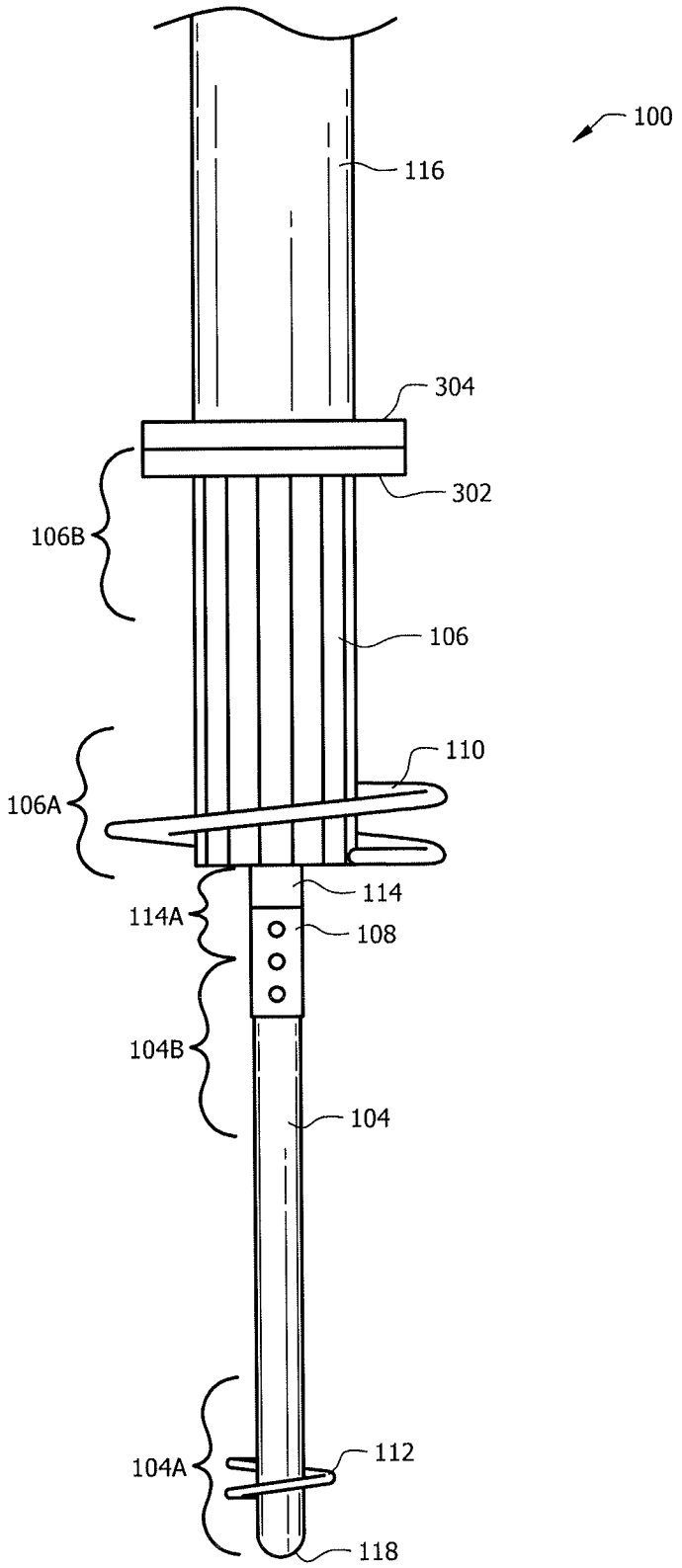
FIG. 3 is a schematic diagram of an embodiment of an embedded pole system with base plates.

FIG. 3 is a schematic diagram of an embodiment of an embedded pole system 100 using base plates 302 and 304. The embedded pole system 100 comprises an intermediate pole 106, an inner sleeve 114, a leading pole 104, and a coupler 108. The intermediate pole 106, an inner sleeve 114, a leading pole 104, and a coupler 108 may be configured similarly to as described in FIG. 1. The embedded pole system 100 may be configured such that the first portion 114A of the inner sleeve 114, the first portion 106A of the intermediate pole 106, and the leading pole 104 are disposed within a foundation 102 and such that the second portion 106B of the intermediate pole 106 is coupled to the utility pole 116 above the surface of the foundation 102. The second portion 106B of the intermediate pole 106 and the utility pole 116 do not penetrate the foundation 102. The utility pole 116 may be configured similarly to as described in FIG. 1. The second portion 106B of the intermediate pole 106 comprises base plate 302 that is configured to mate with or engage a base plate 304 that is disposed on the utility pole 116. In one embodiment, the base plate 302 may be a driving head that may be used to screw the intermediate pole 106 into the foundation 102. A driving head is described in more detail in FIG. 5. The base plates 302 and 304 may be coupled together using one or more fasteners, for example, bolts, screws, a coupler, or clamps. In one embodiment, base plates 302 and 304 may be coupled together using a breakaway type fastener that allows the fasteners to shear upon impact and to uncouple base plates 302 and 304 and thereby uncouple the utility pole 116 from the intermediate pole 106. In another embodiment, base plates 302 and 304 may be coupled together using a fixed connection, for example, a weld or bond.

Figure 4:
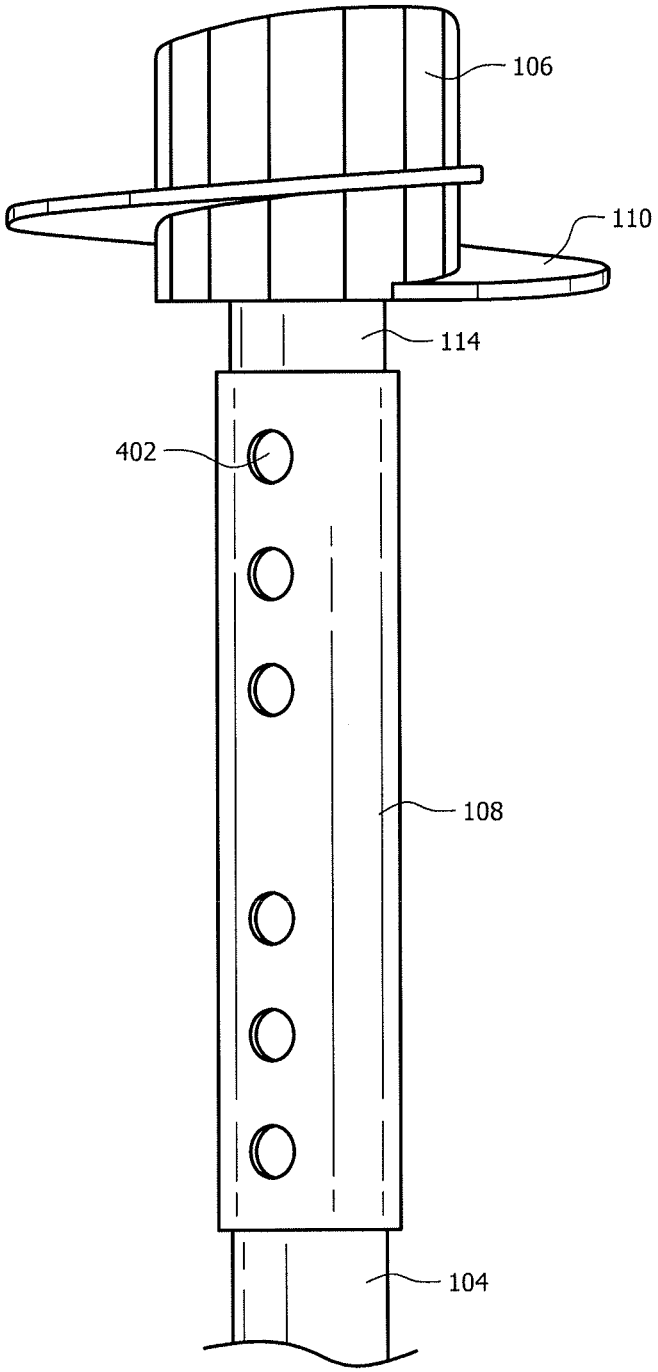
FIG. 4 is a schematic diagram of an embodiment of a coupler for an embedded pole system.

FIG. 4 is a schematic diagram of an embodiment of a coupler 108 for an embedded pole system 100. The coupler 108 may be configured similarly to as described in FIG. 1. The coupler 108 is configured to couple the leading pole 104 the inner sleeve 114. In FIG. 4 the coupler 108 is a tubular pole with a diameter that is greater than the diameter of the inner sleeve 114 and the diameter of the leading pole 104. The coupler 108 may comprise a plurality of holes or slots 402 that allow the coupler 108 to be fastened (e.g. bolted) to the leading pole 104 and the inner sleeve 114. The plurality of slots 402 may provide flexibility for coupling to the leading pole 104 and the inner sleeve 114 and/or increased support when coupling to the leading pole 104 and the inner sleeve 114. For example, the plurality of slots 402 may allow multiple fasteners to be used to couple to the leading pole 104 and the inner sleeve 114 to increase support. Other embodiments may employ similar or different coupling mechanisms.

Figure 5:
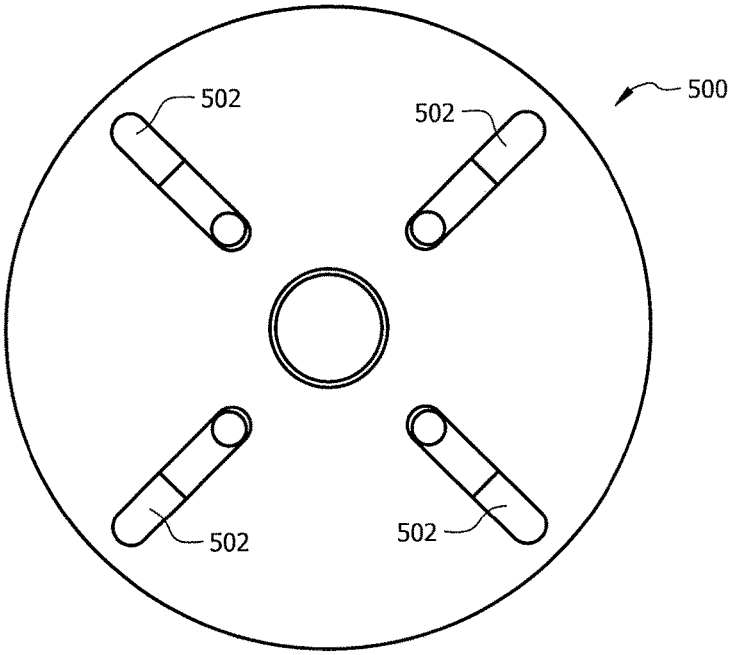
FIG. 5 is a top view of an embodiment of a driving head for an embedded pole system.

FIG. 5 is a top view of an embodiment of a driving head 500 for an embedded pole system 100. The driving head 500 may be coupled to the intermediate pole 106 and/or the inner sleeve 114 to screw the intermediate pole 106 into the foundation 102. In FIG. 5, the driving head 500 has a circular shape. Alternatively, the driving head 500 may be any other suitable shape. In one embodiment, the driving head 500 may be removably coupled to the intermediate pole 106 or the inner sleeve 114. For example, the driving head 500 may be coupled to the intermediate pole 106 or inner sleeve 114 via a base plate 302. The driving head 500 may comprise one or more holes or slots 502 that allow the driving head 500 to be installed (e.g. bolted) onto the intermediate pole 106, the inner sleeve 114, or base plate 302. In another embodiment, the driving head 500 may be fixed to or integrated with the intermediate pole 106 or the inner sleeve 114. For example, the driving head 500 may be configured as a base plate 302 disposed on the intermediate pole 106. When the driving head 500 is configured as the base plate 302, the driving head 500 may be used to couple the intermediate pole 106 to the base plate 304 of the utility pole 116.

Figure 6:
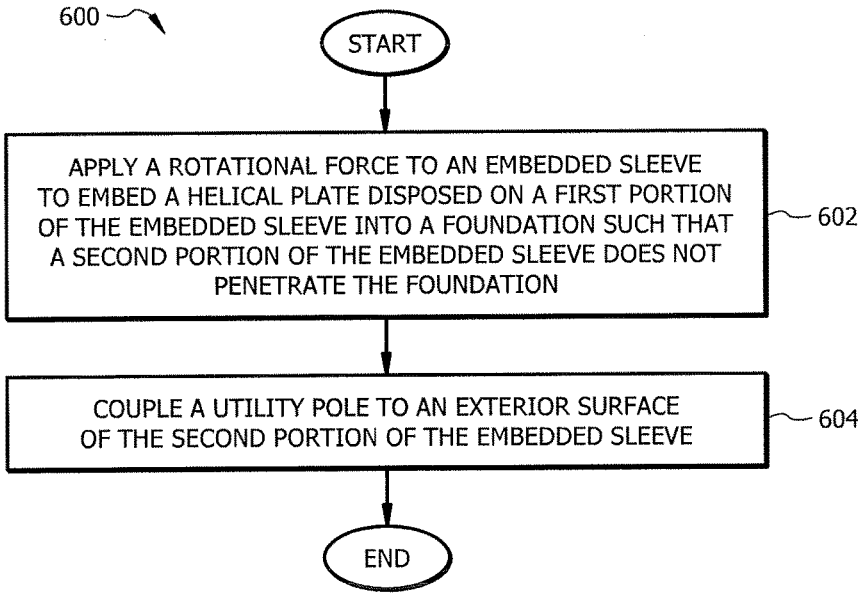
FIG. 6 is a flowchart of an embodiment of an embedded pole installation method for an embedded pole system.

FIG. 6 is a flowchart of an embodiment of an embedded pole installation method 600 for an embedded pole system 100. Method 600 may be implemented by a technician or an installer to install and secure the embedded pole system 100 into a foundation (e.g. the ground). For example, a technician may implement method 600 to install the embedded pole system 100 into the ground at a work location to support the utility pole 116 (e.g. an electrical power transmission pole). The technician may obtain and assemble the embedded pole system 100, which may be configured similarly to the embedded pole system 100 described in FIGS. 1-3.

At step 602, the technician applies a rotational force to the intermediate pole 106 to embed (e.g. screw) the helical plate 110 that is disposed on the first portion 106A of the intermediate pole 106 into the foundation 102. The technician may apply the rotational force to the intermediate pole 106 by rotating a driving head 500 that is coupled to the intermediate pole 106 or using any other suitable technique as would be appreciated by one of ordinary skill in the art upon viewing this disclosure. The intermediate pole 106 is positioned such that the second portion 106B of the intermediate pole 106 does not penetrate the foundation 102. In other words, the first portion 106A of the intermediate pole 106 is screwed into the foundation 102 to a suitable depth that also allows the second portion 106B of the intermediate pole 106 to remain uncovered by the foundation 102. When the embedded pole system 100 is configured with the leading pole 104 coupled the intermediate pole 106, the rotational force that is applied to the intermediate pole 106 is also applied to the leading pole 104, which embeds (e.g. screws) the helical plate 112 that is disposed on the first portion 104A of the leading pole 104 into the foundation 102. The rotational force may be applied to embed the intermediate pole 106 and the leading pole 104 into the foundation 102 to any suitable depth as would be appreciated by one of ordinary skill in the art upon viewing this disclosure.

At step 604, the technician couples the utility pole 116 to the exterior surface 106C of the second portion 106B of the intermediate pole 106. In one embodiment, the utility pole 116 is positioned and disposed onto the outer surface 106C of the second portion 106B of the intermediate pole 106 such that at least a portion of the intermediate pole 106 is within the bore 116B of the utility pole 116. The friction between the outer surface 106C and the inner surface 116A forms a slip joint that couples the intermediate pole 106 and the utility pole 116 together. For example, the intermediate pole 106 and the utility pole 116 may be coupled together similarly to as shown in FIGS. 1 and 2.

In another embodiment, when the intermediate pole 106 is configured with the base plate 302 and the utility pole 116 is configured with the base plate 304, the utility pole 116 is positioned or disposed on the second portion 106B of the intermediate pole 106 such that the base plate 304 is mated with or engages the base plate 302. Base plates 302 and 304 are then coupled together using fastener or a fixed connection to couple the intermediate pole 106 to the utility pole 116. For example, the intermediate pole 106 and the utility pole 116 may be coupled together similarly to as shown in FIG. 3.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. §112(f) as it exists on the date of filing hereof unless the words "means for" or "step for" are explicitly used in the particular claim.

The invention claimed is:

1. An embedded pole system comprising:

a leading pole comprising a first helical plate disposed on a first portion of the leading pole;

an intermediate pole coupled to a second portion of the leading pole, the intermediate pole comprising a second helical plate disposed on a first portion of the intermediate pole, and wherein a diameter of the intermediate pole is greater than a diameter of the leading pole;

a utility pole coupled to a second portion of the intermediate pole;

the leading pole comprising a third portion opposite the first portion of the leading pole;

the first portion of the leading pole positioned under a ground surface in an installed configuration of the embedded pole system;

the third portion of the leading pole positioned above the ground surface in the installed configuration;

the intermediate pole comprising the second portion opposite the first portion of the intermediate pole;

the first portion of the intermediate pole positioned under the ground surface in the installed configuration;

the second portion of the intermediate pole positioned above the ground surface in the installed configuration.

2. The system of claim 1, wherein the utility pole is coupled to the intermediate pole using friction between an interior surface of the utility pole and an exterior surface of the second portion of the intermediate pole.

3. The system of claim 1, wherein the utility pole is coupled to the intermediate pole using a slip-joint between the utility pole and the intermediate pole.

4. The system of claim 1, wherein the utility pole is a tapered tubular pole.

5. The system of claim 1, wherein:

the utility pole is a multi-sided tubular utility pole; and the intermediate pole has a multi-sided exterior that corresponds with the multi-sided tubular utility pole.

6. The system of claim 1, wherein:

the intermediate pole includes an inner sleeve longitudinally disposed within the intermediate pole in a recess defined by the intermediate pole;

the inner sleeve comprises a first sleeve portion not enclosed within the intermediate pole; and the first sleeve portion of the inner sleeve of the intermediate pole is coupled to the leading pole.

7. The system of claim 1, wherein:

the intermediate pole includes an inner sleeve longitudinally disposed within the intermediate pole in a recess defined by the intermediate pole;

the inner sleeve comprises a first sleeve portion not enclosed within the intermediate pole; and the first sleeve portion of the inner sleeve is configured to interface with a driving head to apply a rotation force to the intermediate pole.

8. The system of claim 1, wherein the intermediate pole tapers such that the diameter of the intermediate pole at the first portion of the intermediate pole is greater than the diameter of the intermediate pole at the second portion of the intermediate pole.

9. The system of claim 1, wherein:

the utility pole comprises a first base plate;

the second portion of the intermediate pole comprises a second base plate; and the utility pole is coupled to intermediate pole using fasteners to couple the first base plate to the second base plate.

10. The system of claim 9, wherein the fasteners are breakaway fasteners configured to shear upon impact.

11. An embedded pole installation method comprising:

providing the embedded pole system of claim 1; and applying a rotational force to:

the leading pole comprising the first helical plate disposed on the first portion of the leading pole; and the intermediate pole coupled to the second portion of the leading pole, the intermediate pole comprising the second helical plate disposed on the first portion of the intermediate pole, wherein the diameter of the intermediate pole is greater than the diameter of the leading pole, wherein applying the rotational force embeds the first helical plate and the second helical plate into the ground surface, and wherein the second portion of the intermediate pole does not penetrate the ground surface; and coupling the utility pole to the second portion of the intermediate pole.

12. The method of claim 11, wherein coupling the utility pole to the intermediate pole comprises using friction between an interior surface of the utility pole and an exterior surface of the intermediate pole.

13. The method of claim 11, wherein coupling the utility pole to the intermediate pole comprises using a slip-joint between the utility pole and the intermediate pole.

14. The method of claim 11, wherein coupling the utility pole to the intermediate pole comprises hydraulically jacking an interior surface of the utility pole and an exterior surface of the intermediate pole together.

15. The method of claim 11, wherein:

the utility pole comprises a first base plate;

the second portion of the intermediate pole comprises a second base plate; and coupling the utility pole to the intermediate pole comprises fastening the first base plate to the second base plate.

16. The method of claim 11, wherein the second base plate is a driving head.

17. The method of claim 11, wherein:

the intermediate pole includes an inner sleeve longitudinally disposed within the intermediate pole in a recess defined by the intermediate pole, wherein the inner sleeve comprises a first sleeve portion not enclosed within the intermediate pole, and wherein the first sleeve portion of the inner sleeve of the intermediate pole is coupled to the leading pole; and applying the rotational force to the inner sleeve rotates the intermediate pole.

18. The method of claim 11, wherein coupling the utility pole to the intermediate pole comprises engaging a multi-sided interior surface of the utility pole to a multi-sided exterior of the intermediate pole that corresponds with the multi-sided interior surface of the utility pole.

19. The method of claim 11, wherein:

the second portion of the intermediate pole is coupled to a driving head; and applying the rotational force to the driving head rotates the intermediate pole.

* * * * *